United States Patent [19]

Gretler

[11] 4,289,002

[45] Sep. 15, 1981

[54] KEY FOR A CYLINDER LOCK AND METHOD FOR MAKING SAME

[75] Inventor: Heinrich Gretler, Hinwil, Switzerland

[73] Assignee: Bauer Kaba AG Sicherheits-Schliessyteme, Switzerland

[21] Appl. No.: 882,882

[22] Filed: Mar. 2, 1978

Related U.S. Application Data

[63] Continuation of Ser. No. 720,784, Sep. 7, 1976, abandoned.

[30] Foreign Application Priority Data

Sep. 11, 1975 [CH] Switzerland ..... 11820/75

[51] Int. Cl.[3] ..... E05B 27/06

[52] U.S. Cl. ..... 70/358; 70/364 A; 70/406

[58] Field of Search ..... 70/358, 364 A, 378, 70/393, 402, 405, 406

[56] References Cited

U.S. PATENT DOCUMENTS

| | | | |
|---|---|---|---|
| 3,349,587 | 10/1967 | Keller. | |
| 3,393,542 | 7/1968 | Crepinsek | 70/406 |
| 3,412,588 | 11/1968 | Schwegler | 70/358 |
| 3,413,831 | 12/1968 | Crepinsek. | |
| 3,605,462 | 9/1971 | Hermann. | |
| 3,877,267 | 4/1975 | Harris | 70/358 |
| 3,889,501 | 6/1975 | Fort. | |

FOREIGN PATENT DOCUMENTS

| | | | |
|---|---|---|---|
| 664635 | 9/1965 | Belgium | 70/364 A |
| 260517 | 0/0000 | Switzerland. | |

OTHER PUBLICATIONS

The History of Locks.
Publication of Hurd Lock Co.

*Primary Examiner*—Robert L. Wolfe
*Attorney, Agent, or Firm*—Roylance, Abrams, Berdo & Farley

[57] ABSTRACT

Recesses in a key are formed by a cutter having a shape corresponding to the shape of the tumbler pin to be associated with the recess. The recesses to receive perpendicularly extending pins are formed with parallel opposed side walls perpendicular to the key surface to decrease the total space required for recesses of greatest step value. Recess for 45° inclined permutations are formed with one flat wall. Methods and apparatus are disclosed.

10 Claims, 11 Drawing Figures

KEY FOR A CYLINDER LOCK AND METHOD FOR MAKING SAME

This is a continuation of application Ser. No. 720,784, filed Sept. 7, 1976, and now abandoned.

The invention relates to a key for a cylinder lock with recesses for the tumbler pins.

The invention also relates to a method for manufacturing the key.

BACKGROUND OF THE INVENTION

In known flat keys with recesses for receiving the preferably cylindrical tumbler pins located in radially displaceable manner in the lock rotor, the recesses are drilled out of the flat side of the key, so that conical countersunk hole are formed on the key shank. Thus, the largest diameter on the key surface of each hole is a function of the depth of the particular hole, i.e., the larger the depth or step value of the particular recess selected corresponding to the lateral permutation of the flat key, the larger the diameter.

In principal a corresponding relationship between the depth and width of the key recess also exists if, in order to conceal the actual position of the tumbler pins and consequently making unauthorized duplication of the key more difficult, the recesses are formed so that they are elongated in the longitudinal direction of the key, i.e., are not drilled out but are instead milled into the key shank or blade with a milling cutter of the same shape and size as the drill for the above-mentioned countersunk holes. The reason is that the largest width of a milled ablong recess measured on the key surface at right angles to the key shank corresponds, for a milled recess of the same depth as for the countersunk hole to the largest diameter of the recess made as a conical countersunk hole on the key surface.

A recess made in the form of a countersunk hole takes up just as much space longitudinally and transversely relative to the key shank, although in the case of drilled recesses with larger step depths in which the cylindrical portion of the tumbler pin engaged in the recess is located below the key surface, the space requirement at right angles to the key could be smaller because the diameter of the associated cylindrical tumber pins in considerably smaller than the largest diameter of the conical countersunk hole measured on the key surface. This largest bore diameter is, in fact, necessary in order to form cam or slide surfaces for the tumbler pins on the sides of the recess which extend in the longitudinal direction of the key up to the surface thereof and which are preferably inclined at an angle of 45° thereto. Thus, on removing the key, the pin tips thereof can perfectly ascend these side portions up to the surface of the key.

In connection with the space requirement in the area of the key surface, fundamentally the same applies for the oblong milled recesses as for the conical countersunk holes, but in this case the excessively large space requirement at right angles to the key is an even greater disadvantage and specifically when the flat key is used as a turning key with a double recess design.

In the case of flat keys, it is also known to permit the recesses formed lengthwise for concealing the tumbler positions and successively milled in a row in the longitudinal direction of the key to pass into one another, whereby then the slides for the tumbler pins do not, or do not all, extend up to the key surface, but instead depending on the depth difference of successive step depths, differ in length. However, here again at least in the case of the recesses with the greatest step depth of the 90° later permutation, the disadvantage of the excessively large space requirement at right angles to the key shank still exists (Swiss Pat. No. 260,517).

In addition, the excessively large three-dimensional space requirement, particularly of milled oblong recesses of the 90° lateral permutation, makes it impossible to use smaller key thicknesses with a reduced shank cross-section relative to the width and thickness such as would be desirable for use with lock cylinders with smaller diameters while retaining the number of permutations. In addition, due to the excessively large width of the recess at right angles to the key, the tumbler pins for an edge permutation to be provided on the narrow side of the key can only have a correspondingly reduced diameter or only a restricted insertion depth.

A further disadvantage of the hitherto known methods for manufacturing flat keys with longitudinally milled recesses is that they are either very complicated or in the case of profile milling machines with a plurality of juxtaposed control slide valves are too imprecise, regarding the precision of the slides on the recesses, for the desired clean ascent of the tumbler pins on removing the key.

BRIEF SUMMARY OF THE INVENTION

An object of the invention is to overcome these disadvantages.

According to the invention, this problem is solved by a key of the type specified hereinbefore which is characterized in that at least one recess of the key has at least one planar side portion adjacent to the key surface which in the longitudinal direction of the key is parallel to the longitudinal median plane of the recess and to the axis of the associated tumbler pin.

The invention also relates to a method for manufacturing the key which is characterized in that the recess is milled into the key with a milling cutter whose cylindrical portion radius corresponds to the distance of the planar side portion of the recess from its longitudinal median plane running in the longitudinal direction of the key, whereby for producing rectilinear slides for the tumbler pins the milling cutter is displaced with a constant longitudinal feed speed and simultaneously with a constant speed for the depth feed motion and the subsequent depth retraction motion, whereby the feed and retraction commands for the cutter come from the same control source.

BRIEF DESCRIPTION OF THE DRAWINGS

Other and further objects of the present invention will be apparent from the following description and claims and are illustrated in the accompanying drawings which form a part of this specification and which show preferred embodiments of the present invention and the principles thereof, and what are now considered to be the best modes contemplated for applying these principles. Other embodiments of the invention embodying the same or equivalent principles may be used, and structural changes may be made as desired by those skilled in the art without departing from the present invention and the scope of the appointed claims. In the drawings:

DETAILED DESCRIPTION OF THE PREFERRED EMBODIMENTS

Figure 1:
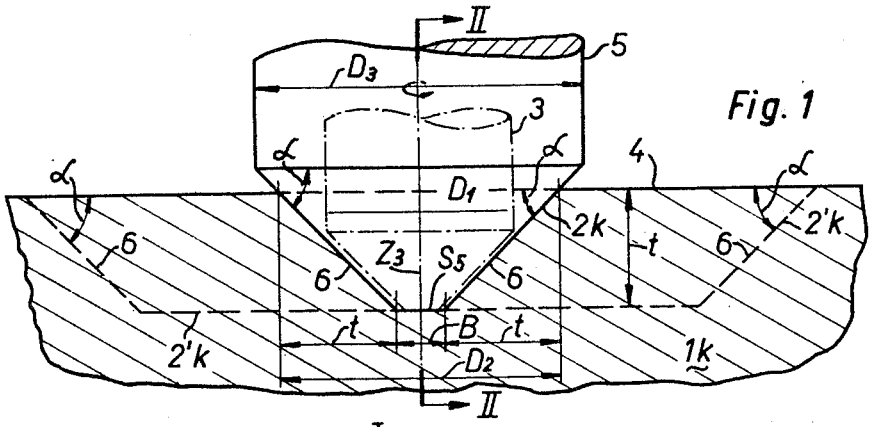
FIG. 1 is a partial sectional plan view of a conventional flat key with a recess of the 90° lateral permutation in the form of a countersunk hole, in longitudinal section along the line I—I of FIG. 2.

FIG. 1 shows a cutaway portion of a conventional flat key 1*k* showing one of the recesses for the tumbler pins of the 90° lateral permutation which are drilled out from its two flat sides as conical countersunk holes 2*k*. FIG. 1 shows one such recess 2*k* with a cylindrical tumbler pin 3 of diameter D1, indicated with dotted lines, engaged therein, in a longitudinal section of the key 1*k*. On the key surface 4 recess 2*k* has its largest diameter D2 whose size is dependent on the particular depth of bore t. In the case of a drill 5 with a conical bit of 90°, the diameter-depth relationship follows an equation $D2=2t+B$, wherein the quantity B corresponds to the diameter of a circular surface S5 of the base of the recess which results from the flat end of the conical bit of drill 5. From this relationship it will be seen that if the same drill 5 is used for making all the recesses of 2*k* of 90° lateral permutation with increasing bore or step depth t, the largest diameter D2 of recess 2*k* measured on key surface 4 increases by double the amount of the particular depth increase.

Furthermore, for a recess 2*k* with the greatest step depth t occurring in the 90° lateral permutation, the maximum recess diameter D2 also follows the equation $D3 \geqq D2$, wherein D3 is the diameter of the cylindrical part of drill 5. This ensures that, even with the greatest occurring step depth t, two slides 6 for the tumbler pin 3 are formed on the sides of the recess which extend from the base of the recess to the key surface 4, which slides are inclined by an angle of $\alpha=45°$ relative to the key surface and which are at the ends of the recess in the longitudinal direction of the key, so that on removing the flat key 1*k* from the cylinder lock its conical tip cleanly ascends on this side portion 6 up to the key surface 4.

The drill diameter D3 is generally made somewhat larger than the largest diameter D2 of the deepest recess 2*k*, as is shown in exaggerated manner in FIG. 1, in order to ensure that when drilling the recesses 2*k* with the greatest step depth t, the drill 5 does not undercut the key surface 4 with its cylindrical portion and, therefore, starting from the surface, produces a cylindrical side portion on recess 2*k* which is perpendicular to the key surface 4 and impairs the clean ascent of tumbler pins 3.

FIG. 1 shows with dotted lines a recess 2'*k* of the same depth t as recess 2*k* in FIG. 1 in the form of a conical countersunk hole which is elongated in the longitudinal direction of the key and extends symmetrically to equal distances on either side of the tumbler pin position center Z3 in order to conceal the actual position of the tumbler pin 3. This oblong recess 2'*k* is milled to the key shank with a milling cutter of the same outer contour and size as drill 5. Thus, as the recess 2'*k* is fundamentally only a lengthwise-formed conical countersunk hole 2*k*, in principle the same geometrical equations as in the case of recess 2*k*, drilled in the key shank in the form of a conical countersunk hole, apply in connection thereto for the greatest width measured on the key surface 4 at right angles to the key shank, i.e., its dependence on the step depth t on the one hand and the milling cutter (corresponding to the drill diameter D3) on the other. Thus, in the case of the oblong milled recess 2'*k*, it is ensured that in the longitudinal direction of the key, its sides form two slides 6 for the conical tips of the tumbler pin 3 extending up to the key surface 4 and inclined at an angle $\alpha$ of 45° relative thereto, which is indispensable for the clean ascent thereof onto and along the recess side during removal of the key.

Figure 2:
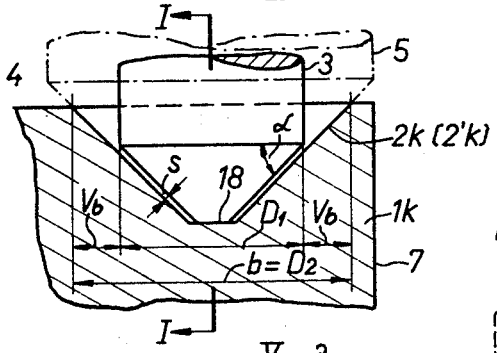
FIG. 2 is an end elevation in partial section along the line II—II of FIG. 1.

FIG. 2 shows in a cross-section the conventional flat key 1*k* according to FIG. 1 with the tumbler pin 3 engaged in the conical recess 2*k*. Here the diameter ratio D1/D2 of tumbler pin 3 and recess 2*k* clearly shows the excessively large space requirement of recess 2*k* at right angles to the key shank, from which it can be seen that the space lost on either side of tumbler pin 3 measured on key surface 4 is, in each case, Vb. The reason is that the largest internal width of recess 2*k* on the key surface 4 is $b=D2$, although in actual fact only a width of D1 (plus the side tolerance) was necessary there.

In the case of milled recesses 2'*k* extended in the longitudinal direction of the key (cf. FIG. 1), the excessive space requirements at right angles to key 1*k* is even more pronounced because here the two loss quantities Vb are drawn out lengthwise in strip-like manner in the longitudinal direction of the key corresponding to the extension quantity of recess 2'*k* on key surface 4, which can, in fact, lead to considerable difficulties when making flat keys for use as turning keys with a double recess element, i.e., with two rows of recesses per flat side and, intermediate thereof, recesses of a 45° additional permutation drilled out at an angle in two rows at 45° to the key surface 4, resulting in a narrowing down of the combination width of the total permutation or the maximum number of tumbler pins or recesses for a given key length.

The necessary side tolerance between the conical tip of the tumbler pin 3 and the sides of the conical or oblong recess 2*k* or 2'*k* for the clean mounting of the tumbler pins 3 engaging in the particular recesses 2*k* or 2'*k* on the base 18 of the recess, and therefore the completely satisfactory arrangement of the tumblers in the lock cylinder, is designated by s in FIG. 2. Conical or oblong recesses can be provided as edge steps for additional tumblers on the narrow side of the flat key designated by 7 in FIG. 2.

Figure 3:
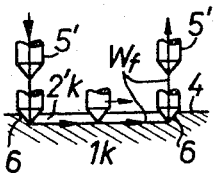
FIG. 3 is a schematic diagram of a prior art milling cutter feed motion for making a longitudinally milled recess of the 90° lateral permutation of a conventional flat key, in a longitudinal section of the key.

FIG. 3 shows a hitherto conventional milling method for making conventional flat keys k with extended recesses 2'*k*. During its total travel Wf for making a recess 2'*k* of the 90° lateral permutation, a milling cutter 5' firstly performs a feed motion perpendicular to the key surface 4 and then a feed motion parallel thereto and finally a retraction motion perpendicular thereto. As a result of the movements of the milling cutter 5' perpendicular to the key surface 4, the two 45° slides 6 are produced along the key 1*k* on the recess ends and, in this connection, there are considerable difficulties relative to the necessary mechanical control of the cutter movement.

Figure 4:
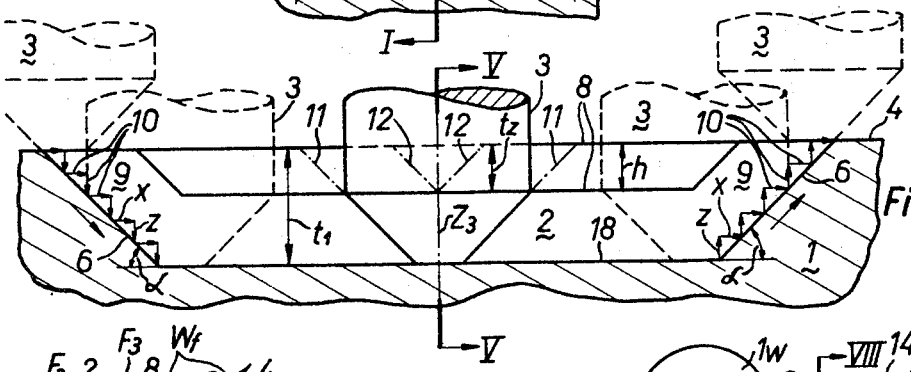
FIG. 4 is a partial plan view, in partial section of a flat key according to the invention with a longitudinally milled recess of maximum step depth of the 90° lateral permutation along the line IV—IV of FIG. 5.
Figure 5:
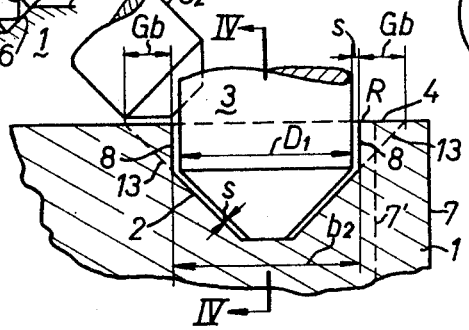
FIG. 5 is an end elevation in partial section along the line V—V of FIG. 4.

FIG. 4 shows a cutaway portion of a flat key 1 according to the invention with an oblong recess 2 of the 90° lateral permutation of the greatest step depth T1 milled in the key shank on its flat side as well as a cylindrical tumbler pin 3 engaged therein. The trough-like recess 2 extending in the longitudinal direction of key 1 has, on the key surface 4 and at right angles to the longitudinal dimension of the key, a maximum width b2 which is the same as diameter D1 of the cylindrical tumbler pin 3, plus the side tolerance s thereof as shown in FIG. 5. Furthermore, each of the longitudinal sides of the recess 2 has a planar side portion 8 adjacent and perpendicular to the key surface 4, said portion extending in the longitudinal direction of the key and parallel to the axis of tumbler pin 3. Thus, the two planar side portions 8 also extend parallel to the longitudinal median plane of recess 2, i.e., to its main plane of symmetry running in the longitudinal direction of the key and perpendicular to the key surface 4 and also parallel to one another, and are perpendicular to key surface 4. The height h of these two planar side portions 8 corresponds to the insertion depth of the cylindrical portion of the tumbler pin 3 engaged in the recess 2 designated by tz in FIG. 4. The planar side portions 8 are interconnected to each other at their ends by, at each end, a side portion 9 extending from the oblong base 18 of the recess to the key surface 4, so that the portion 9 has the shape of a frustum surface sector and, corresponding to the 90° conical tip of the tumbler pin 3, is inclined at an angle of 45° to the key surface 4 and to the base 18 of the recess which is parallel thereto. Step-like lines 10 on the two ends of the oblong milled recess 2 in FIG. 4 show in vector-like representation the feed speeds driving the milling cutter, whose size and outer contour is now the same as that of the tumbler pin 3. The cutter is moved simultaneously in the directions indicated and is driven equally rapidly and, therefore, equally far in the horizontal and vertical directions x and z, thus resulting in 45° motion of the cutter for producing a 45° slide 6 for the tumbler pin 3 extending from the base 18 of the recess up to the key surface 4. On the right-hand side of FIG. 4, it is similarly shown that on further movement in the x direction, it is retracted in the z direction. Furthermore, the dotted lines in FIG. 4 show various momentary positions of the tumbler pin 3 assumed by the latter with reference to the oblong recess 2 which moves along beneath it on removing or inserting the flat key 1 from or into the key channel of the lock cylinder, not shown for reasons of clarity in FIG. 4. Furthermore, in FIG. 4 the two dot-dash lines 11 and 12 show a recess of minimum length which, corresponding to the flattened conical tip of tumbler pin 3, has a circular recess base and which is extended only relatively slightly in the longitudinal direction of the key on either side in the area of key surface 4 starting from the position center Z3 of the engaged tumbler pin 3.

FIG. 5 shows a cross-section of the flat key 1 according to FIG. 4 with the tumbler pin 3 engaged in the recess 2. This clearly shows that the space requirement for recess 2 at right angles to the key is adapted to the diameter D1 of the cylinder tumbler pin 3 due to the two planar side portions 8 located perpendicularly on key surface 4, and as a result considerable space-saving takes place on key surface 4 at right angles to the key shank. For comparison purposes, the dotted lines 13 in FIG. 5 show the cross-sectional profile of a conventional recess milled in conventional manner (2'*k* in FIGS. 1 and 2), with the gain in space on either side of tumbler pin 3 measured at right angles to flat key 1 on key surface 4 being designated by the width Gb. Compared with the conventional recess 2*k* or 2'*k* according to FIG. 2, the greatest recess width $b_2$ is larger than the diameter D1 of tumbler pin 3 only by the side tolerance s despite the 45° slide 6 for the tumbler 3 once again provided at the recess ends as seen in FIG. 4.

The saving of area Gb on the key surface 4 corresponds to a three-dimensional space saving which can be used for taking further tumbler pins and specifically for arranging additional recesses for the tumbler pins of a 45° additional permutation inclined to the key surface 4, as shown in FIG. 5 by the tumbler pin 3*z* inclined by 45° to the key surface 4. Since, unlike in the conventional milling process described with reference to FIGS. 1 to 3, it is now possible to select a maximum recess width $b_2$ at right angles to the key for the milled recesses 2 which is independent of the production of the slides (6 in FIGS. 1, 3 and 4) necessary for the tumbler pin 3, i.e., it now only corresponds to the constructional features of the cylinder lock and specifically the diameter D1 of tumbler pins 2, and the width of the key shank can also now be made correspondingly smaller. This is shown by the narrow side 7' of flat key 1 which is moved closer to the recess edge R at key surface 4 compared with the key narrow side 7. This is also advantageous when manufacturing smaller diameter locking cylinders.

Figure 6:
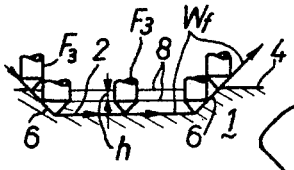
FIG. 6 is a schematic diagram of the path of a milling cutter in accordance with the invention for making the longitudinally milled recess of the flat key shown in FIGS. 4 and 5 and in a longitudinal section of the key.

FIG. 6 schematically shows the milling method according to the invention for making the flat key 1 according to FIGS. 4 and 5. A milling cutter F3, whose size and outer contour corresponds to tumbler pin 3, in its travel Wf for producing the oblong recess 2 initially performs a linear feed movement inclined at an angle $\alpha$ of 45° to the key surface 4 in accordance with FIG. 4 resulting from the step-like lines 10 for the simultaneous and equally large feeds in the x and z direction (to the left in FIG. 4). This is followed by a horizontal feed movement parallel to key surface 4 and finally by a linear retraction movement which is once again at an angle of 45° thereto and results from simultaneous horizontal and vertical feeds indicated by the step-like lines 10 (to the right in FIG. 4). As a result of the two portions of the total milling travel Wf inclined by 45° to the key surface 4, the two 45° slides 6 for the tumbler pin 3 located in the longitudinal direction of the key are produced at the two ends of the trough-like recess 2, and also the horizontal cutter feed produces the two planar lamellar side portions 8 in the area of the central portion of the oblong recess 2 (of also FIG. 4), so that these two planar side portions 8 are formed perpendicularly to the key surface 4 and have a height h which corresponds to the insertion depth of the cylindrical portion of cutter F3. The height h of the two planar lamellar side portions 8 corresponds additionally to the insertion depth of the cylindrical portion of the tumbler pin 3 engaged in recess 2 designated by tz in FIG. 4 because, as stated, the size and outer contour of cutter F3 corresponds to tumbler pin 3.

As previously described, to produce the 45° slides 6, the milling cutter F3 is moved simultaneously at the same speed and therefore equally far in the x and z directions, i.e., for the lengthwise and depth feed. Thus, the feed commands or pulses for these two feed movements can be taken from the same control source. For producing a plurality the oblong recesses 2 arranged successively in a row in the longitudinal direction of the key, which recesses generally pass into one another, and which may have different step values or depths t using in a single cutter pass, i.e., for so-called "continuous path milling", a digitally controlled milling machine is used which is preprogrammed for the particular key permutation either by manual operation from a push-button console or by inserting punched tape. A so-called "computer-controlled" milling machine of this type is equipped with feed stepping motors for the longitudinal and depth feed of the cutter or cutters, said motors receiving their electrical pulses or feed commands simultaneously from the same control source, such as an oscillator, serving as the pulse generator. The data for the particular key permutation, given by the particular punched tape pattern or keyed on a push-button console in accordance with the permutation table, are fed into a computer which controls the different cutter feed processes according to the position, length, depth and speed. As the control source, the oscillator generates electronic pulses whose time-spacing can be varied and which serves to control the feed-stepping motors with an accelerated, decelerated or constant speed. Thus, the varyingly deep oblong recesses 2 or flat key 1 which are arranged successively and in series, as well as at the same time the additional recesses for the tumbler pins 3*z* of a 45° additional permutation inclined at an angle of 45° to the key surface 4 (cf. FIG. 5) are milled into the key shank fully automatically in the continuous path milling process in a single cutter pass in the longitudinal direction of the key.

The milling cutter F3 for the oblong recesses 2 of the 90° lateral permutation corresponds to the tumbler pin, not only as regards the shape and travel, but also relative to the insertion depth in the key shank. This coincidence as regards shape and travel applies with reference to the flat key 1 passing beneath the tumbler pin 3 during the insertion or removal movement of the key. The reason is that in this case, unlike the conventional milling process explained relative to FIGS. 1 to 3, the milling cutter F3 not only has the same diameter D1 and the same outer contour as the tumbler pin 3 (plus the side tolerance s according to FIG. 5), but cutter F3 also completely simulates the movement sequence of tumbler pin 3 on key 1. Fundamentally, the same also applies for the additional recesses of the 45° additional permutation.

Figure 7:
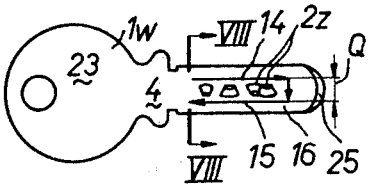
FIG. 7 is a side elevation of a flat key showing the path of the milling cutter for making a key constructed according to the invention as a turning key with recesses of a 90° lateral permutation and a 45° additional permutation.

FIG. 7 shows the cutter travel for making a flat key 1*w* constructed as a turning key with a double recess design. On each of its two flat sides the finished key 12 has two longitudinal rows of successive recesses, not shown in FIG. 7, but similar to those recesses 2 discussed with reference to FIGS. 4 to 6, for the preferably cylindrical tumbler pins 3 of the 90° lateral permutation (cf. FIGS. 4 and 5) as well as, between these two rows, two rows of additional recesses 2*z* for the tumbler pins 3*z* of 45° additional permutation (cf. FIG. 5) inclined at an angle of 45° to the key surface 4. Milling first takes place in the milling direction 14 from the end portion 23 to the tip of the key 25, using the continuous path milling process, to produce a row of oblong recesses 2. Subsequently, after transversely adjusting the cutter F3 (cf. FIG. 6) relative to the key 12 by the quantity q or inversely 1*w* relative to F3, in the opposite milling direction 15 from the key tip 25 to the end portion 23, the other row of recesses 2 according to FIGS. 4 to 6 are produced in the key shank 16 of FIG. 7. The production of the additional recesses 2*z* of the 45° additional permutation which are inclined by 45° relative to the key surface 4 is explained relative to FIG. 8.

Figure 8:
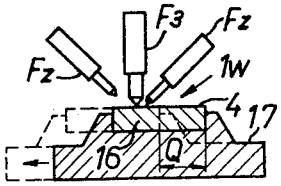
FIG. 8 is an end view, in partial section, showing a milling cutter arrangement for making the turning key according to FIG. 7 with its fastening device along the line VIII—VIII of FIG. 7.

FIG. 8 shows a group of three milling cutters Fz, F3, Fz juxtaposed at right angles to the key for producing the recesses 2 or 2*z* of the flat key 1*w* constructed according to FIG. 7 and a turning key shown in a cross-section through the key which is secured in a fastening device 17. Milling cutter F3 (cf. also FIG. 6) is used for making the two rows of recesses 2 of the 90° lateral permutation (cf. FIGS. 4 to 6) while the two milling cutters Fz are used to produce, in each case, one row of recesses 2*z* of the 45° additional permutation. In this process, during its passes in the longitudinal direction of the key, cutter F3 alternately cooperates with one or the other of the two cutters Fz. In FIG. 8 cutter F3 cuts straight in the milling direction 14 according to FIG. 7 from the end portion 23 towards the key tip 25 to form one of the two longitudinal rows of recesses 2 of the 90° lateral permutation, i.e., the upper row in FIG. 4 and the left-hand row in FIG. 8. However, during this pass of cutter FD, the right-hand cutter Fz in FIG. 8 is simultaneously controlled in such a way that it mills the recesses 2*z* of the 45° additional permutation (cf. FIG. 7) at preprogrammed positions in the milling machine and which, relative to the particular side of the key channel in the cylinder rotor belong to this row of recesses 2 of the 90° lateral permutation, so that said milling takes place in the same milling direction 14 in the key shank 16. Subsequently, the fastening device 17 together with the flat key 1*w* secured therein is transversely adjusted by the quantity q and then, in the milling direction 15 from the key tip 25 to the end portion 23 (cf. FIG. 7), the other longitudinal row of recesses 2 of the 90° lateral permutation is milled in the key shank 16, i.e., in FIG. 7 the lower row and in FIG. 8, following the transverse adjustment q of the fastening device 17, the right-hand row of recesses 2. Simultaneously, the other cutter Fz, on the left-hand side of FIG. 8, mills the other recesses 2*z* of the 45° additional permutation (cf. FIG. 7) belonging to the said row of recesses 2 of the 90° permutation in key shank 16 in the same milling direction 15.

After the recesses 2 of the 90° lateral permutation and, at the same time, the recesses 2*z* of the 45° additional permutation have been milled in this way on one flat side of turning key 1*w*, the key is removed from the device 17 and, after turning by 180°, is secured again so that now the other flat side of turning key 1*w* can be milled in the same way as described hereinbefore relative to FIGS. 7 and 8 to provide it with the corresponding recesses 2 and 2*z* by means of the continuous path milling process. For producing the recess pattern of the flat side of a key in this milling process, the fastening device 17, together with the key 1*w* secured therein can be transversely adjusted by the quantity q relative to the fixed group of cutters Fz, F3, Fz, or, conversely, the set of cutters can be transversely adjusted by the same amount but in the opposite direction relative to the fastening device 17 with the key 1*w* secured therein (cf. FIGS. 7 and 8), this merely constituting a kinematic reversal of workpiece and tool movement.

Apart from the cutter F3 for the recesses 2 of the 90° lateral permutation, the digitally controlled milling machine is also preprogrammed for controlling the feed-stepping motors of the two cutters Fz for the recesses 2*z* of the 45° additional permutation, so that the recesses 2*z* (cf. FIG. 7) produced by these cutters Fz are also milled into the key shank 16 by the continuous path milling process. Like cutter F3, the two cutters Fz completely simulate the movement sequence of tumbler pins 3*z* of the 45° additional permutation (cf. FIG. 5) which takes place on removing or inserting the flat key 1*w*. In this connection, cutter Fz can be considered roughly as a tumbler pin 3*z* of the 45° additional permutation (of FIG. 5) which seeks or takes the correct path in the longitudinal direction of the key. Thus, for the tumbler pin 3*z* of the 45° additional permutation, in place of a point support a real support is now obtained in the area of the conical surface portion of recess 2*z*, together with a geometrically perfect recess configuration for optimum sliding and, therefore, clean ascent of the tumbler pin 3*z* on the recess side.

Figure 9:
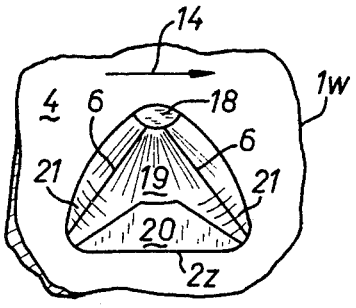
FIG. 9 is a detail side elevation showing a recess of the 45° additional permutation of the turning key according to FIG. 7 on a flat side of the key.

In FIG. 9 which on an enlarged scale shows a cutaway portion of flat key 1*w* according to FIG. 7 in a side view of one of its flat sides, is represented one of the recesses 2*z* of the 45° additional permutation milled in the milling direction 14. This recess 2*z* belongs to that row of additional recesses 2*z* milled by means of the right-hand cutter Fz in FIG. 8 simultaneously with the pass of cutter F3 for the 90° lateral permutation in milling direction 14. These two rows of recesses 2 and 2*z*, in which the additional recesses 2*z* are inclined towards the main recess row 2 of the 90° lateral permutation and produced by cutters F3 and Fz in the same pass in the milling direction 14 belong together not only from the manufacturing standpoint, but also functionally in that the tumbler pins 3 or 3*z* engaging in these two rows of recesses are located on the same side in the locking cylinder rotor with reference to the key channel.

Relative to the recess 2*z* milled in the flat key 1*w* at an angle of 45° to the key surface 4 in the milling direction 14, i.e., in the longitudinal direction of the key by means of the continuous path milling process, FIG. 9 shows the planar circular surface base 18 of the recess inclined by 45° to the key surface 4 resulting from the flat end of conical bit of cutter Fz (cf. FIG. 8) as well as a conical surface recess wall portion 19 following the same and corresponding to the conical tip of cutter Fz. It is also possible to see an approximately triangular flat recess wall portion 20 following on wall portion 19 which results from the cylindrical part of cutter Fz and therefore is perpendicular to the inclined base 18 or is an an angle of 45° to the key surface 4 but is directed oppositely to base 18. There are also two transitional wall portions 21 between the two wall portions 19 and 20 and which are produced by the cutter-axial depth feed or depth retraction of cutter Fz during its longitudinal feed in the milling direction 14. Finally, it shows the two slides 6 extending up to the key surface 4 for the tumbler pins 3*z* (cf. FIG. 5) of the associated 45° additional permutation row which are engaged or removed relative to recess 2*z*.

Figure 10:
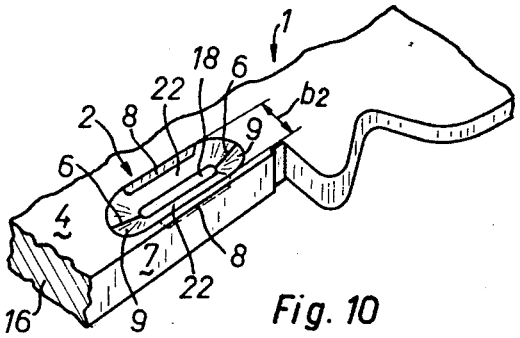
FIG. 10 is a partial perspective view of the key of FIGS. 4 and 5 showing a recess of maximum step depth of the 90° lateral permutation of the flat key.

FIG. 10 again shows the recess 2 of greater step depth of the 90° lateral permutation of flat key 1 according to FIGS. 4 and 5 for better comparison of its differentiating and coinciding features relative to recess 2*z* of the 45° additional permutation according to FIG. 9, in this case in three-dimensional form. It is again possible to see the elongated flat base 18 of the recess parallel to the key surface, as well as the two parallel flat recess wall portions 8 (cf. also FIGS. 4 to 6) resulting from the cylindrical part of milling cutter F3 inserted into the key material underneath key surface 4 (cf. FIG. 6) which are perpendicular to the base 18 of the recess and to the key surface 4 and which, corresponding to the longitudinal displacement of cutter F3 (cf. FIG. 6) extend in the longitudinal direction of the key. It is also possible to see the two conical surface wall portions 9 externally connected to the flat wall portions 8, resulting from the conical tip of cutter F3, which form the two 45° slides 6 for the tumbler pin 3 (cf. FIG. 4), and the two flat recess wall portions 22 diverging towards the key surface 4 which also result from the conical tip of cutter F3 and extend in the longitudinal direction of the key are also shown. FIG. 10 also shows that the elongated milled recess in key shank 16 only has a maximum width b2 at right angles to the key due to the flat side portions 8 perpendicular thereto, i.e., has a correspondingly reduced space requirement (cf. also FIG. 5) so that compared with the conventionally milled recess 2*k* (cf. FIGS. 1 to 3), the recess can also be located nearer to the narrow side 7 of flat key 1 (cf. also FIGS. 2 and 5).

Figure 11:
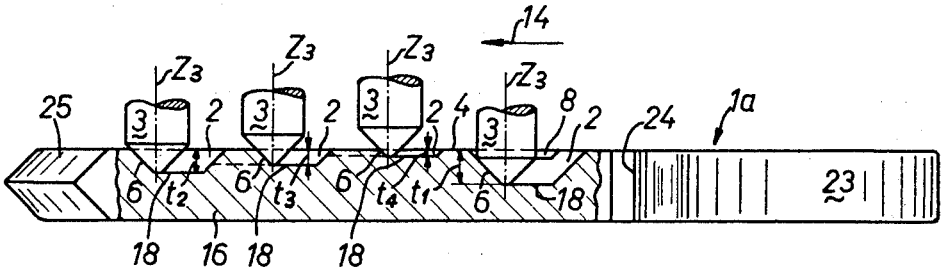
FIG. 11 is a plan view, partially in section, of the narrow side of a flat key with a row of recesses of the 90° lateral permutation extended on only one side.

FIG. 11 shows a longitudinal row of elongated recesses 2 of the 90° lateral permutation milled into key shank 16 by the continuous path milling process in direction 14 from end portion 23 to the key tip 25 in a plan view on one of the two narrow sides 7 of a flat key 1*a*. Here again the recesses 2 which succeed one another in the longitudinal direction of the key and whose bases are again designated by the reference numeral 18 are elongated on only one side in the direction of the end portion 23 or the key stop face 24 from the position center Z3 of the again preferably cylindrical tumbler pin 3 when the key is fully inserted into the lock and wherein the recess side 6 facing the key tip 25 and serving as 45° slides for tumbler pins 3 are at the same time supporting sides for limiting longitudinal movement in the event of pulling of the inserted flat key 1*a*, when the key and rotor has already been turned somewhat from the insertion or removal rotation position, as described in Swiss patent application No. 11821/75, corresponding to U.S. patent application Ser. No. 720,783, filed Sept. 7, 1976. As in FIGS. 4 and 10, recess 2 adjacent to the end portion 23 of the key has the greatest step depth T1 and therefore once again has two flat wall portions perpendicular to the key surface 4. In FIG. 11, as indicated by means of dotted lines, the four recesses 2 which succeed one another in the longitudinal row and which have four different step depths $t_1$, $t_2$, $t_3$ and $t_4$ can also be milled in key shank 16 so that they pass into one another, in which event in certain cases, as in FIG. 11, relative to the two recesses 2 with step depths $t_3$ and $t_4$ which pass into one another, the supporting side 6 which limits longitudinal pulling of the key can be omitted or its length can be reduced. Nevertheless, with reference to at least one recess and preferably that with the greatest step depth T1 a supporting side 6 should always be provided in order to ensure longitudinal movement limitation for the inserted flat key 1*a* which has already been turned somewhat from its insertion or removal rotation position, thereby effectively counteracting premature pulling on the key during its rotation, which can lead to so-called "hanging up" of tumbler pins of an additional permutation on "extraneous" stator bores and consequently the blocking of further rotation of rotor and key.

If the flat key 1*a* shown in FIG. 11 with the recesses 2 of the 90° lateral permutation extended on only one side is constructed as a turning key with a double recess design, i.e., being provided on each of its two flat sides with, in each case, two longitudinal rows of successive recesses 2 of the 90° lateral permutation, as was explained relative to FIGS. 7 and 8, then only the recesses 2 of one row on each flat side of the key 1*a* is extended from its tumbler center Z3 in the direction of end portion 23 (cf. FIG. 11), so that only in this row of recesses are bearing sides for longitudinal pull limitation of the key 1*a* formed from the recess side 6 lacing the key tip 25, whereas the recesses 2 of the other row are extended from their tumbler center Z3 in the direction of key tip 25 and therefore in said other row of recesses no bearing sides for longitudinal pull limitation of the key are formed in the recess sides facing key tip 25 so that therefore the recesses 2 of this other row when assuming their function of identification between key and locking cylinder relative to the particular insertion position of the turning key 1*a* as so-called "active" recesses, they do not exercise a longitudinal pull limitation function for the inserted key. Therefore, in the case of the flat key 1*a* constructed as a turning key according to FIG. 11, the longitudinal pull limitation of the key in each of its two insertion positions only takes place on one of its two flat sides, which have identical recess designs and namely on that flat side on which the recesses 2 of the then "active" recess row 2 of the 90° lateral permutation is extended from tumbler center Z3 in the direction of end portion 23 and consequently the longitudinal pull-limiting bearing sides 6 facing key tip 25 are formed (cf. FIG. 11).

The opposing recess extensions in the two rows of recesses located on one flat side of a key and the equivalent arrangement of the recess extensions on the two flat sides of the flat key 1*a* constructed as a turning key according to FIG. 11 can be explained relative to FIGS. 7 and 8 which also show a turning key 1*w* in conjunction with FIG. 11, the following system being used.

As already explained relative to FIGS. 7 and 8, milling cutter F3 (cf. FIG. 8) when milling the two rows of recesses for the 90° lateral permutation in a first pass moves in the milling direction 14 from end portion 23 to key tip 25 and subsequently, after transverse adjustment Q of cutter F3 or fastening device 17, the cutter moves in the opposite milling direction 15 from key tip 25 to end portion 23. Then, following a 180° rotation about the longitudinal axis of the key in the fastening device 17, the key 1*w* (cf. FIG. 7) is resecured and the same milling process with exactly the same cutter passes, preprogrammed for both flat keys, is now performed relative to the other key flat side in accordance with the arrowed line 14—Q—15 of FIG. 7. Thus, milling cutter F3 produces the same recess designs with an equivalent arrangement of the recesses for the 90° lateral permutation on the two flat sides of turning key 1*w*.

When producing recesses 2 extended in only one direction from the tumbler pin axis with longitudinal pull-limiting bearing sides 6 (cf. FIG. 11), cutter F3 during the milling of such an elongated recess 2 should only leave behind it the recess extension extending from its tumbler center Z3 in the direction of end portion 23 in order to ensure maximum manufacturing precision. The reason is that the position and shape of the longitudinal pull-limiting bearing recess sides 6 are made more precisely if produced from the solid key material on the return pass of the cutter, i.e., not when the cutter tip is first placed on the key surface 4 (cf. FIGS. 7, 8 and 11) and its subsequent insertion into the material of key shank 16.

Thus, when producing a turning key with recesses 2 extended in only one direction according to FIG. 11 in its complete travel 14—Q—15 according to FIG. 7, the cutter produces only the recess extensions extending from the tumbler center Z3 in the direction of end portion 23, which are known as "recess tails", only during the first longitudinal pass in the direction 14 from end portion 23 to key tip 25, and therefore with the longitudinal pull-limiting bearing recess sides 6 facing the key tip 25 as can be gathered from FIG. 11 in conjunction with FIG. 7. However, in the second cutter pass when milling the other longitudinal row of recesses 2 on the same flat side of the key but in the opposite milling direction 15 (cf. FIG. 7), the recess extensions left behind the cutter as so-called "recess tails" extend from tumbler center Z3 in the opposite direction to the key tip and therefore in the case of recesses 2 of this longitudinal row the recess sides facing key tip 25 do not form bearing sides for the longitudinal pull limitation of the key. Thus, in the case of the flat key 1*a* constructed as a turning key with recesses of the 90° lateral permutation extended on one side, not only is the fact that the "recess tails" in the two longitudinal rows of one flat side of key 1*a* point in opposite directions but also the equivalent arrangement of the "recess tails" on its two flat sides is explained.

An important advantage of the key according to the invention, and the method for making the same as explained relative to the previous embodiments, is that the recesses with the greatest step depth of the 90° lateral permutation require much less space compared with the hitherto used recesses in the form of conical countersunk holes, and particularly compared with the elongated recesses conventionally milled at right angles to the key, due to the flat recess wall portions perpendicular to the key surface. The space gained in this way on the key surface can be advantageously used for providing further tumbler pins, specifically at a 45° lateral permutation which is particularly advantageous in the case of flat keys constructed as turning keys with a double recess design. Due to the reduced width of the deepest recesses of the 90° lateral permutation on the recess wall portion running in the longitudinal direction of the key and formed on the key surface, the narrow sides of the key can be moved closer together, i.e., the width of the key shank can be correspondingly reduced so that smaller diameter locking cylinders become possible. Furthermore, due to the avoidance of excessively large recess widths at right angles to the key, the possibility now exists, in the case of the oblong recesses milled into the narrow side of the flat key as edge steps, to increase the greatest step depth occurring with the edge permutation and therefore the step range without thereby having to correspondingly increase the thickness of the key shank and therefore the whole key. The reason is that the greatest recess width at right angles to the key both for the flat sides and the narrow sides of the key according to the invention is independent of the greatest step depth.

The continuous path milling process used for making the key in accordance with the present invention is characterized, in connection with the large numbers involved in key manufacture, by increased economy, but more particularly and importantly, by greater manufacturing precision which is an important advantage when making flat keys in the form of turning keys with a 45° additional permutation, i.e., when there is to be a relatively large number of recesses on the key surface. Despite the undercutting of the key surface by the cylindrical cutter part, the recesses with the greatest step depth of the 90° lateral permutation or an edge permutation still obtain geometrically absolutely perfect slides for the tumbler pins extending correctly up to the key surface and preferably inclined by 45° relative thereto so that on removing the key they smoothly and cleanly ascent the recess side with their tip. The present continuous path milling process completely eliminates the hitherto encountered imprecisions of slides of key recesses which were unavoidable with conventional copy milling with juxtaposed control slide valves in the longitudinal direction of the key. In addition corrections of shape on the tumbler pins of the 45° additional permutation, such as the selection of a somewhat reduced cone angle of, e.g., 84° instead of 90° at the pin tip and the subsequent rounding at the transition from the conical tip to the cylindrical part of the tumbler pin at the expense of its guidance length in the rotor bore hitherto necessary due to this lack of precision of the sides are now eliminated. Furthermore, the continuous path milling process according to the invention also makes it possible in advantageous manner to make those keys in which the recesses of the 90° lateral permutation are drawn lengthwise to conceal the actual position of the tumbler pins, but which according to previously mentioned Swiss patent application No. 11821/75 for maintaining a bearing side for longitudinal pull limitation of the inserted key which has, however, already been turned somewhat from its insertion or removal rotation position, are extended on one side only from the position center in the direction of the end portion of the key, whereby here again the reduced recess width at right angles to the key like the geometrically perfect construction of the slides for the tumbler pins are advantageous.

The construction of the key according to the invention and the inventive method for producing the same is in no way limited to flat keys and in fact it can be used for other random key shank cross-sections, e.g., a cross-section with a radial arrangement of the tumbler planes. Instead of making the tumbler pins which engage in the key recesses cylindrical, they can also be given non-circular cross-sections. Therefore, the invention is not limited to the embodiments described hereinbefore relative to the drawings, and numerous variants are possible thereto without passing beyond the scope of the invention.

What is claimed is:

1. In a key for a cylinder lock, the key comprising an elongated blade having a blade surface with a plurality of recesses therein to receive tumbler pins of the lock, the lock having a plurality of tumbler pins forming a permutation inclined relative to said blade surface, the improvement wherein at least one recess of said plurality of recesses includes a planar base portion spaced inwardly from said blade surface, a planar side wall portion spaced from said base portion and lying adjacent to said blade surface and inclined relative thereto, said planar side wall portion having substantially the shape of an isosceles triangle and lying in a plane parallel to the longitudinal dimension of said blade; and a conical side wall surface portion extending between said base portion and said planar side wall portion.

2. A key and a cylinder lock therefor, said lock comprising a plurality of cylindrical tumbler pins; and said key comprising an elongated blade having a key surface with a first plurality of recesses therein for receiving said tumbler pins and having a key tip at one end thereof, at least one recess of said first plurality of recesses being elongated in a direction perpendicular to the central axis of its associated tumbler pin and parallel to the longitudinal direction of said blade, and comprising first and second substantially parallel planar side wall portions adjacent to said key surface and extending in the longitudinal direction of said blade, said first and second wall portions being parallel to the longitudinal median plane of said one recess and to the central axis of its associated tumbler pin;

a substantially planar base portion, said planar side wall portions being spaced from said base portion;

third and fourth substantially planar wall portions extending between said base portion and said first and second wall portions, respectively; and sloping end wall portions defining rectilinear slide surfaces for cooperation with its associated tumbler pin, said slide surfaces being aligned with the longitudinal dimension of said blade and extending outwardly from said base portion.

3. A key and a cylinder lock therefor, said lock comprising a plurality of tumbler pins with a cylindrical portion and frustoconical distal ends; and said key comprising an elongated key blade with a key surface having a first plurality of recesses therein to receive said tumbler pins; said first plurality of recesses being of a lateral permutation perpendicular to said key surface, being longitudinally arrayed along said key blade and having a plurality of different depths; one of first plurality of recesses having the greatest depth of said first plurality of recesses and a maximum width substantially equal to the diameter of its associated tumbler pin, but slightly greater than said diameter, to receive said associated pin in close fitting sliding relationship; said one recess comprising first and second substantially parallel planar side wall portions adjacent to said key surface and extending in the longitudinal direction of said blade, said first and second wall portions being parallel to the longitudinal median plane of said one recess and to the central axis of its associated tumbler pin and having a height in a direction perpendicular to said key surface equal to the insertion depth of said associated tumbler pin cylindrical portion;

a substantially planar base portion, said planar side wall portions being spaced from said base portion;

third and fourth substantially planar wall portions extending between said base portion and said first and second wall portions, respectively; and sloping conical end wall surface portions defining rectilinear slide surfaces for cooperation with its associated tumbler pin, said slide surfaces being aligned with the longitudinal dimension of said blade and extending outwardly from said base portion.

4. A key and lock according to claim 3, wherein at least one of said slide surfaces of said one recess extends up to said key surface.

5. A key and lock according to claim 3, wherein said slide surfaces are inclined at a 45° angle relative to said key surface.

6. A key and a cylinder lock therefor, said lock comprising a plurality of cylindrical tumbler pins; and said key comprising an elongated blade having a key surface with a first plurality of recesses therein for receiving said tumbler pins and having a key tip at one end thereof; at least one recess of said first plurality of recesses being elongated in a direction perpendicular to the central axis of its associated tumbler pin and parallel to the longitudinal direction of said blade, and comprising first and second substantially parallel planar side wall portions adjacent to said key surface and extending in the longitudinal direction of said blade, said first and second wall portions being parallel to the longitudinal median plane of said one recess and to the central axis of its associated tumbler pin;

a substantially planar base portion, said planar side wall portions being spaced from said base portion;

third and fourth substantially planar wall portions extending between said base portion and said first and second wall portions, respectively; and sloping end wall portions defining rectilinear slide surfaces for cooperation with its associated tumbler pin, said slide surfaces being aligned with the longitudinal dimension of said blade and extending outwardly from said base portion; and said key surface having a second plurality of recesses for receiving tumbler pins forming a permutation inclined relative to said key surface; at least one recess of said second plurality of recesses comprising a planar base section, a planar side wall section adjacent to said key surface and inclined relative thereto in substantially the shape of an isosceles triangle, and a conical side wall surface section between said base section and said planar side wall section.

7. A key and a lock according to claim 6, wherein said at least one recess of said second plurality of recesses forms a 45° additional permutation, said planar side wall section is inclined at an angle of 45° to said key surface, and wherein said conical side wall surface section, two transitional side wall sections and said planar side wall section form two slides for tumbler pins extending from said base section to said key surface and inclined by an angle of 45° relative to said key surface.

8. A key and lock according to claim 2, wherein said one recess is elongated in one longitudinal direction of said blade from the center portion of its associated tumbler pin in order to conceal the position of its associated tumbler pin.

9. A key and lock according to claim 8 wherein said one recess is elongated in only one direction from the central portion of its associated tumbler pin and from said end wall portion of said one recess facing away from said key tip to limit longitudinal movement of the key when fully inserted in the lock and turned from its insertion or removal position by the engagement of said associated tumbler pin and said one end wall portion facing away from said key tip.

10. A key and lock according to claim 2, wherein recesses are provided on both sides of said key blade.

* * * * *